US009253824B2

(12) United States Patent
Inoue et al.

(10) Patent No.: US 9,253,824 B2
(45) Date of Patent: Feb. 2, 2016

(54) STEAM GENERATOR

(75) Inventors: Kazuhiko Inoue, Toyoake (JP); Eiji Suzuki, Toyoake (JP); Shinichi Kaga, Toyoake (JP); Yukimasa Takeda, Toyoake (JP); Akihiko Hirano, Toyoake (JP); Hiroshi Kai, Toyoake (JP); Masao Sanuki, Toyoake (JP); Motohiko Mouri, Toyoake (JP); Yoshitaka Uchihori, Settsu (JP)

(73) Assignees: HOSHIZAKI DENKI KABUSHIKI KAISHA, Toyoake-Shi (JP); SETA GIKEN CO., LTD., Ibaraki-Shi (JP)

( * ) Notice: Subject to any disclaimer, the term of this patent is extended or adjusted under 35 U.S.C. 154(b) by 1050 days.

(21) Appl. No.: 13/125,861

(22) PCT Filed: Oct. 23, 2009

(86) PCT No.: PCT/JP2009/068280
§ 371 (c)(1),
(2), (4) Date: Oct. 12, 2011

(87) PCT Pub. No.: WO2010/047393
PCT Pub. Date: Apr. 29, 2010

(65) Prior Publication Data

US 2012/0037145 A1 Feb. 16, 2012

(30) Foreign Application Priority Data

Oct. 23, 2008 (JP) ..... 2008-273601

(51) Int. Cl.
*A47J 27/04* (2006.01)
*F22B 1/28* (2006.01)
(Continued)

(52) U.S. Cl.
CPC ..... *H05B 6/108* (2013.01); *B24B 49/105(2013.01); F01K 17/02* (2013.01); *F22B 1/281* (2013.01); *F22B 37/26* (2013.01)

(58) Field of Classification Search
CPC .... H05B 6/108; H05B 6/02; H05B 2206/024; H05B 6/106; H05B 6/1209; H05B 6/36; A47J 27/16; A47J 31/4403; A47J 31/465; A47J 36/2433; F24H 2250/08; F24H 3/0405; F24H 9/0021; F24H 9/2028; B24B 49/105; F01K 17/02; F22B 1/281
USPC ..... 99/293, 294, 410, 413, 417, 93; 219/607, 628–631, 401; 126/369
See application file for complete search history.

(56) References Cited

U.S. PATENT DOCUMENTS 2,407,562 A * 9/1946 Lofgren ..... 219/630
2,427,361 A * 9/1947 Lofgren ..... 219/628
(Continued)

FOREIGN PATENT DOCUMENTS

EP 580899 A1 * 2/1994
EP 1 914 479 A1 4/2008
(Continued)

OTHER PUBLICATIONS

WO2009031325 Steam Generating Apparatus Translation.*
(Continued)

*Primary Examiner* — Eric Stapleton
(74) *Attorney, Agent, or Firm* — Nixon & Vanderhye P.C.

(57) ABSTRACT

A small steam generator uses a cylindrical steam generation vessel having a steam generation portion formed to store an amount of water for generating steam and a steam passage portion formed on the upper end of the steam generation portion for spouting steam generated in the steam generation portion. A heater element is disposed within the steam generation vessel, and an induction heating coil is wound around the periphery of the steam generation vessel for energizing the heater element. The heater element is energized by supply of electric power to the heating coil so that steam generated by boiling of the water in the steam generation portion spouts upward from the steam passage. In the steam generator, a steam discharge duct is mounted on the upper end of the steam passage for receiving the steam spouting upward from the steam passage and to discharge it in a lateral direction such that drops of hot water adhered to a ceiling surface of the discharge duct fall and re-circulate back into the steam generation part.

5 Claims, 4 Drawing Sheets

(51) Int. Cl.

| | |
|---|---|
| ***H05B 6/10*** | (2006.01) |
| ***B24B 49/10*** | (2006.01) |
| ***F01K 17/02*** | (2006.01) |
| ***F22B 37/26*** | (2006.01) |

(56) References Cited

U.S. PATENT DOCUMENTS

| | | | | | |
|---|---|---|---|---|---|
| 2,573,719 | A | * | 11/1951 | Lebherz | 220/231 |
| 3,190,997 | A | * | 6/1965 | Rothacker | 219/629 |
| 3,777,117 | A | * | 12/1973 | Othmer | 392/469 |
| 4,341,936 | A | * | 7/1982 | Virgin | 219/630 |
| 4,471,191 | A | * | 9/1984 | Greis et al. | 219/629 |
| 4,503,305 | A | * | 3/1985 | Virgin | 219/630 |
| 4,814,567 | A | * | 3/1989 | De Angelis et al. | 219/628 |
| 4,855,552 | A | * | 8/1989 | Marceau et al. | 219/630 |
| 5,211,845 | A | * | 5/1993 | Kaneshige | 210/186 |
| 5,222,185 | A | * | 6/1993 | McCord, Jr. | 392/314 |
| 5,237,144 | A | * | 8/1993 | Iguchi | 219/628 |
| 5,286,942 | A | * | 2/1994 | McFadden et al. | 219/630 |
| 5,350,901 | A | * | 9/1994 | Iguchi et al. | 219/630 |
| 5,523,550 | A | * | 6/1996 | Kimura | 219/772 |
| 5,655,212 | A | * | 8/1997 | Sekhar et al. | 428/552 |
| 5,773,797 | A | * | 6/1998 | Uemura | 219/628 |
| 5,781,581 | A | * | 7/1998 | Fishman et al. | 373/152 |
| 5,869,812 | A | * | 2/1999 | Creamer et al. | 219/401 |
| 5,873,298 | A | * | 2/1999 | Chang | 99/340 |
| 5,990,465 | A | * | 11/1999 | Nakaoka et al. | 219/629 |
| 6,008,482 | A | * | 12/1999 | Takahashi et al. | 219/687 |
| 6,107,605 | A | * | 8/2000 | Creamer et al. | 219/401 |
| 6,175,100 | B1 | * | 1/2001 | Creamer et al. | 219/401 |
| 6,288,373 | B1 | * | 9/2001 | Jahn et al. | 219/607 |
| 6,307,193 | B1 | * | 10/2001 | Toole | 219/735 |
| 6,335,517 | B1 | * | 1/2002 | Chauviaux et al. | 219/628 |
| 6,485,228 | B1 | * | 11/2002 | Komatsu | 405/52 |
| 6,622,616 | B1 | * | 9/2003 | Measom | 99/345 |
| 6,734,405 | B2 | * | 5/2004 | Centanni et al. | 219/628 |
| 6,904,903 | B1 | * | 6/2005 | Vroom | 126/20 |
| 6,906,296 | B2 | * | 6/2005 | Centanni et al. | 219/628 |
| 6,967,315 | B2 | * | 11/2005 | Centanni et al. | 219/628 |
| 7,087,873 | B2 | * | 8/2006 | Hayakawa et al. | 219/682 |
| 7,115,845 | B2 | * | 10/2006 | Nomura et al. | 219/630 |
| 7,145,114 | B2 | * | 12/2006 | Wakamatu et al. | 219/629 |
| 2002/0153369 | A1 | * | 10/2002 | Uemura | 219/628 |
| 2003/0215226 | A1 | * | 11/2003 | Nomura et al. | 392/397 |
| 2003/0230567 | A1 | * | 12/2003 | Centanni et al. | 219/628 |
| 2004/0182855 | A1 | * | 9/2004 | Centanni | 219/628 |
| 2004/0250690 | A1 | * | 12/2004 | Restis et al. | 99/403 |
| 2005/0006382 | A1 | * | 1/2005 | Hayakawa et al. | 219/682 |
| 2005/0178761 | A1 | * | 8/2005 | Wakamatsu et al. | 219/629 |
| 2006/0243141 | A1 | * | 11/2006 | Mayer et al. | 99/495 |
| 2010/0219180 | A1 | * | 9/2010 | Bamen | 219/628 |

FOREIGN PATENT DOCUMENTS

| | | | | |
|---|---|---|---|---|
| EP | 2186502 | A1 | * | 5/2010 |
| JP | 05-231601 | | | 9/1993 |
| JP | 11-94203 | | | 4/1999 |
| JP | 2003-0213303 | | | 1/2003 |
| WO | 98/41336 | A1 | | 9/1998 |
| WO | WO 2009031325 | A1 | * | 3/2009 |

OTHER PUBLICATIONS

International Search Report for PCT/JP2009/068280, dated Jan. 19, 2010.

EPO Communication and Supplementary European Search Report re EP 09 82 2090 dated Aug. 8, 2013.

* cited by examiner

STEAM GENERATOR

This application is the U.S. national phase of International Application No. PCT/JP2009/068280 filed 23 Oct. 2009 which designated the U.S. and claims priority to JP Patent Application No. 2008-273601 filed 23 Oct. 2008, the entire contents of each of which are hereby incorporated by reference.

TECHNICAL FIELD

The present invention relates to a steam generator adapted for use in a steam convection oven and the like.

BACKGROUND

Disclosed in Japanese Patent Laid-open Publication 1999-094203 is a steam generator adapted for use in a cooking appliance of foodstuffs, which comprises an upright boiler in the form of a vertical cylindrical body provided with an electromagnetic induction heater and connected at its lower end to a header for connection with a water supply system and a drain system, a vertical bypass duct connected at its intermediate portion with a steam discharge pipe laterally extended from the upper end of the cylindrical body of the boiler, and an upstanding pipe connected at its lower end to the header for detecting a level of water in the boiler. In the steam generator, steam introduced into the bypass duct through the discharge pipe spouts upward, and drops of hot water separated from the steam fall in the header and are circulated into the interior of the boiler.

Because in the conventional steam generator, the bypass duct causes drops of hot water contained in the steam to fall in the header connected in common to the water supply system and the drain system, it is difficult to assemble the bypass duct and the upright boiler in a limited space for manufacturing of the appliance in a small size. Because in the conventional steam generator, the interior of the upstanding pipe for detection of the level of water in the boiler is heated, it is likely that a detection sensor disposed in the upstanding pipe would be damaged by heating.

BRIEF SUMMARY

According to the present example embodiments, there is provided a steam generator which comprises a steam generation vessel having a steam generation portion formed to store an amount of water for generation of steam and a steam passage formed on the upper end of the steam generation portion for spouting steam generated in the interior of the steam generation portion, a heating element disposed in the interior of the steam generation portion, an induction heating coil wound around the periphery of the steam generation portion for energizing the heating element, wherein the heating element is energized by supply of electric power to the induction heating coil so that steam generated by boiling of the water in the steam generation portion of the vessel spouts from the steam passage, and wherein a steam discharge duct is provided on the upper end of the steam passage for receiving the steam spouting upward from the steam passage to discharge it in a lateral direction such that drops of hot water adhered to a ceiling surface of the discharge duct fall and circulate into the steam generation portion.

Because in the steam generator, drops of hot water rising by the force of steam generated in the steam generation portion are received by the ceiling surface of the discharge duct and circulated into the steam generation portion, the steam generator can be provided in a simple construction and in a small size without any separate bypass pipe for circulating drops of hot water rising together with the steam. For example, in application to a steam convection oven, the steam generator can be assembled in a limited space at one side of a cooking chamber formed in a housing of the steam convection oven. In addition, drops of hot water circulated into the steam generation portion are useful to enhance the heating efficiency for generation of the steam.

In a practical embodiment, it is preferable that the steam passage is provided with means for receiving drops of hot water jumping from the steam generation portion to spout only the steam upward and for permitting circulation of the drops of hot water into the steam generation portion. In such an embodiment, the steam passage may be provided with a perforated intercept plate which is formed with a plurality of apertures for permitting only the steam passing therethrough and for permitting the drops of hot water falling therethrough from the discharge duct.

In another practical embodiment, it is preferable that a water level detection tank 80 assembled with the steam generation vessel 31 at one side thereof is provided therein with a float switch 81 for detecting a level of water in the steam generation portion and is communicated with the interior of steam generation vessel 30 at the lower end of induction heating coil 50. In such an embodiment, the water in detection tank 80 is not heated by high temperature hot water in steam generation vessel 30 to avoid an error in operation of the float switch. As the water supplied from the source of water flows into the steam generation portion through the water level detection tank, the water does not remain in the water level detection tank to restrain the occurrence of scale.

DESCRIPTION OF THE PREFERRED EMBODIMENTS

Figure 1:
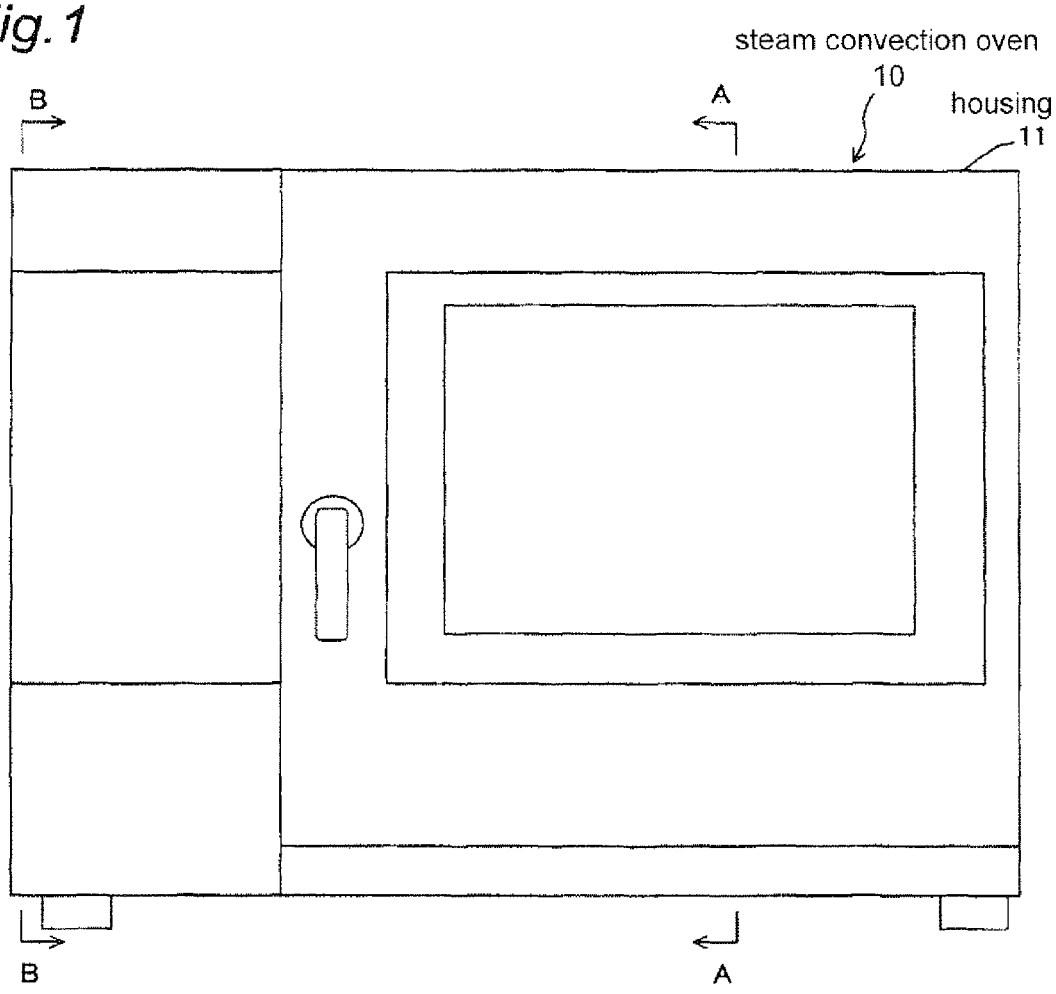
FIG. 1 is a front view of a steam convection oven equipped with a steam generator in accordance with the present invention.
Figure 2:
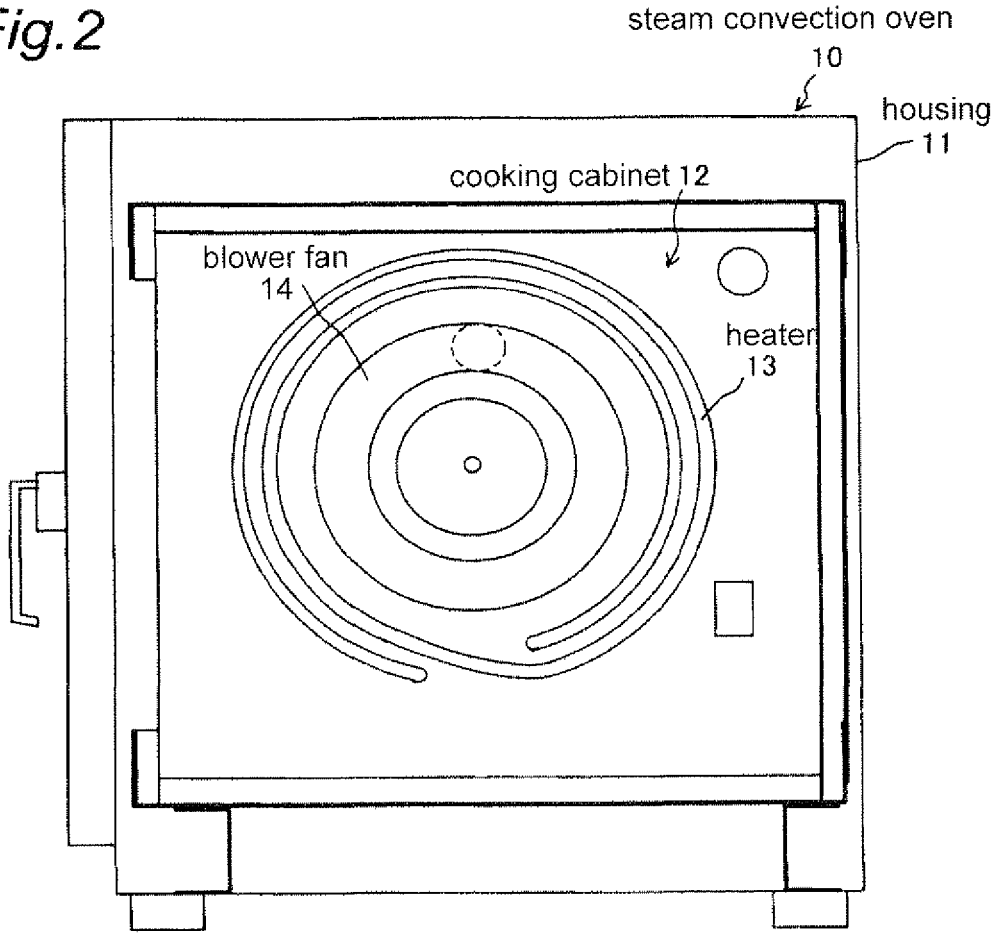
FIG. 2 is a vertical sectional view taken along line A-A in FIG. 1.
Figure 3:
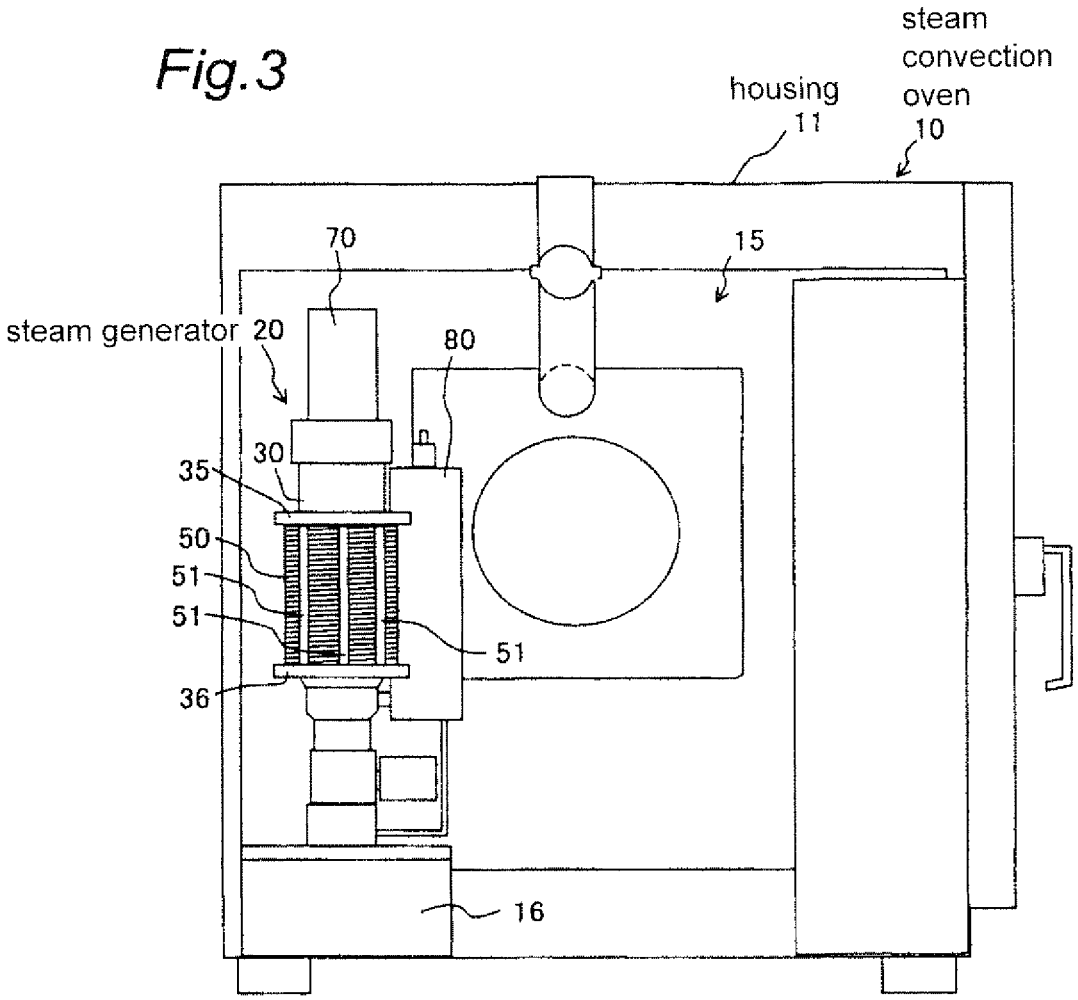
FIG. 3 is a cross-sectional view taken along line B-B in FIG. 1.

Hereinafter, an embodiment of a steam convection oven equipped with a steam generator of the present invention will be described with reference to the accompanying drawings. As shown in FIGS. 1~3, the steam convection oven 10 comprises a cooking cabinet 12 of foodstuffs assembled within a housing 11, a heater 13 installed in the cooking cabinet 12, a blower fan 14 provided in the cooking cabinet 12 for causing convection of the air in the cooking cabinet 12, and a steam generator 20 assembled within a machine chamber 15 formed at one side of the cooking cabinet 12 in housing 11 for supplying steam into the interior of cooking cabinet 12.

Figure 4:
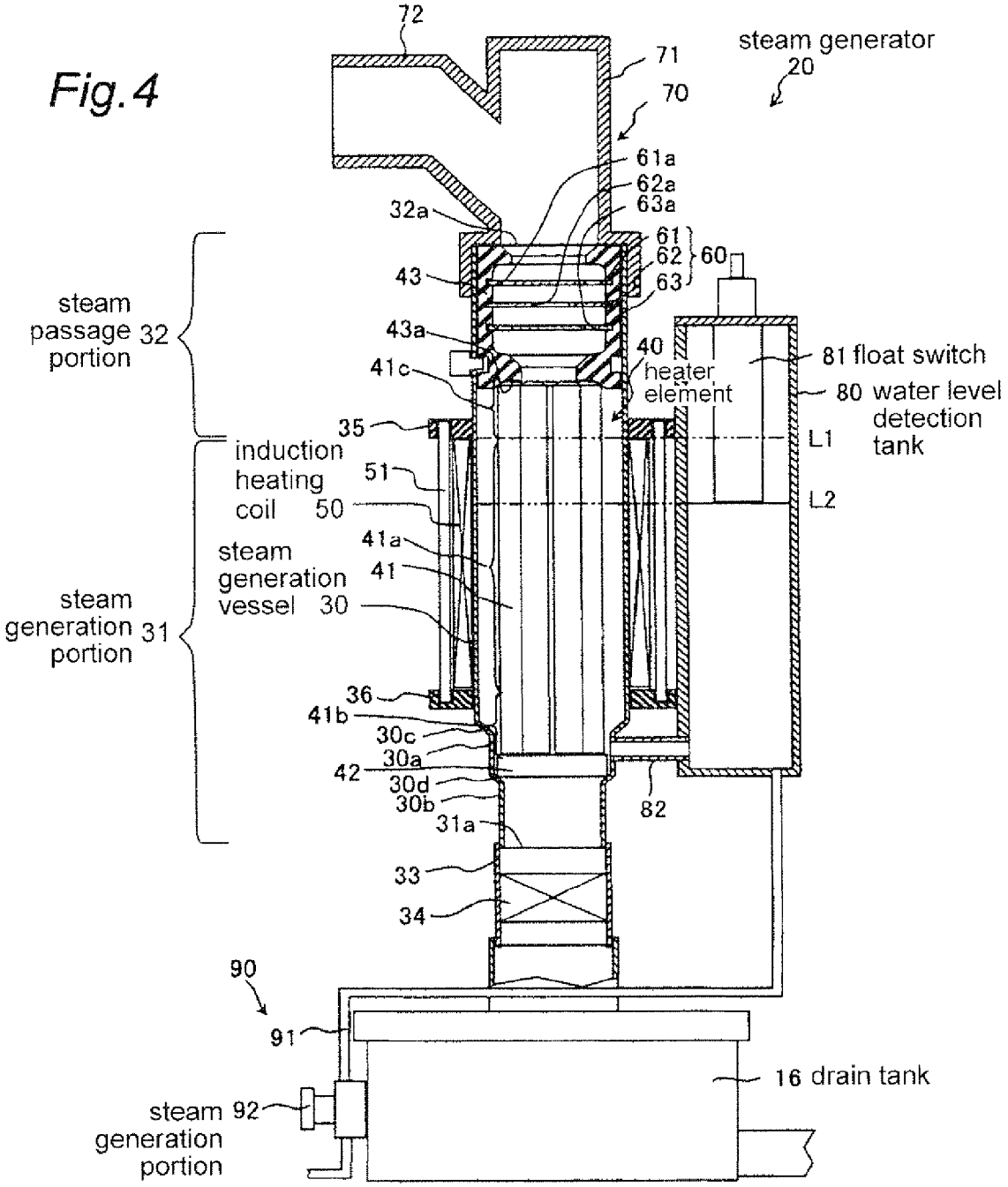
FIG. 4 is an enlarged vertical sectional view of the steam generator shown in FIG. 3.

As shown in FIG. 4, the steam generator 20 includes a cylindrical steam generation vessel 30 having a steam generation portion 31 formed to store an amount of water for generating steam therein and a steam passage portion 32 provided to spout upward the steam generated in the steam generation portion 31, a heater element 40 disposed in the steam generation portion 31 of vessel 30, and an induction heating coil 50 wound around the periphery of steam generation vessel 30 for energizing the heater element 40. In the steam generator 20, the heater element 40 is energized by supply of electric power to the induction heating coil 50 so that the water supplied to the steam generating portion is boiled by heat generated from the heater element 40 and so that steam generated by boiling of the water is discharged from the steam passage portion 32. In this steam generator 20, a steam discharge duct 70 is provided at the upper end of steam passage portion 32 to receive the steam exhausted upward from the steam passage portion and discharge it in a lateral direction so that drops of hot water adhered to a ceiling surface of discharge duct 70 fall to be circulated downwardly back into the steam generation portion 31.

The steam generation vessel 30 is in the form of a vertical cylindrical body of synthetic resin mounted on a drain tank 16 through a joint tube 33. The drain tank 16 is placed on the floor of machine chamber 15 to discharge the water from the interior of cooking cabinet 12. The lower portion of steam generation vessel 30 serves as the steam generation portion 31 to store a specified amount of water for generating steam by heating of the water therein, while the upper portion of steam generation vessel 30 serves as the steam passage 32 to spout upward the steam from the steam generation portion 31.

The steam generation vessel 30 is formed at its lower portion with a first cylindrical extension 30*a* smaller in diameter than the upper portion and a second cylindrical extension 30*b* smaller in diameter than the first cylindrical extension 30*a*. Downward taper surfaces 30*c*, 30*d* are formed at each upper end of the cylindrical extensions 30*a* and 30*b*. A drain outlet 31*a* is formed at the lower end of steam generation vessel 30, and the joint tube 33 is connected to the lower end of steam generation vessel 30. A ball valve 34 is disposed in the joint tube 33 to discharge the water from the steam generation vessel 30 into the drain tank 16 when it is opened.

The heater element 40 disposed in the steam generation vessel 30 is composed of seven heating rods 41 each of which is in the form of a conductive metallic rod. The heating rods 41 are circumferentially equally spaced and fixed in place by engagement with an annular holder 42 at their lower ends and by engagement with a cylindrical holder 43 at their upper ends. Thus, the heating rods 41 are vertically mounted within the steam generation vessel 30 to provide a heat generation part 41*a* at the same height position as the induction heating coil 50. Each lower end part of heating rods 41 is provided as a non-heat-generation part 41*b*, while each upper end part of heating rods 41 is also provided at a non-heat-generation part 41*c*. The holder 42 positioned at the lower end of heat generation portion 31 is in the form of an annular member of synthetic resin formed to permit water to pass therethrough. The holder 42 is fixedly engaged with the taper surface 30*d* between the first and second cylindrical extensions 30*a* and 30*b* of steam generation vessel 30 to support the lower ends of heating rods 41. The cylindrical holder 43 positioned at the upper end of steam generation portion 31 is made of synthetic resin and is formed at its bottom surface with an annular recess 43*a* for retaining the upper ends of heating rods 41. This cylindrical holder 43 is fixedly coupled with the upper end of steam generation vessel 30 in a condition wherein the upper ends of heating rods 41 are fixed in place by engagement with the annular recess 43*a*.

The steam generation vessel 30 is provided at its outer periphery with annular brackets 35 and 36 which are spaced in a vertical direction. The induction heating coil 50 is wound around the periphery of vessel 30 between the brackets 35 and 36. A plurality of circumferentially spaced rod-like ferrite magnets 51 are mounted to the upper and lower brackets 35 and 36 to prevent electromagnetic wave leaking from the induction heating coil 50.

The steam passage 32 of vessel 30 is provided with an intercept portion 60 for intercepting drops of high temperature hot water jumping from the steam generation portion 31. The intercept portion 60 includes three perforated intercept plates 61~63 mounted within the cylindrical holder 43 at vertically spaced positions. The intercept plates 61~63 each are formed with apertures 61*a*~63*a* which are arranged for permitting drops of hot water falling therethrough from a cylindrical portion 71 of a steam discharge duct 70. In this embodiment, the middle intercept plate 62 is formed at its center with a circular aperture 62*a*, while the upper and lower intercept plates 61 and 63 each are formed with a plurality of circular apertures 61*a*, 63*a* which are located radially outward from the aperture 62*a* of intercept plate 62.

The steam discharge duct 70 is mounted on the upper end of steam passage portion 32 of vessel 30 for discharging steam spouting from an outlet 32*a* of vessel 30 into the interior of cooking cabinet 12. The steam discharge duct 70 includes the cylindrical portion 71 closed at its ceiling and upstanding from the outlet 32*a* of steam generation vessel 30 and a cylindrical outlet portion 72 laterally extended from the upstanding cylindrical portion 71 for connection with a steam inlet of cooking cabinet 12. The ceiling of steam discharge duct 70 receives steam containing drops of high temperature hot water spouting from the outlet 32*a* of steam passage 32 and causes the drops of hot water to separate from the steam. Thus, the steam separated from the drops of hot water is discharged into the interior of cooking cabinet 12 through the outlet portion 72 of duct 70.

A water level detection tank 80 is assembled with the steam generation vessel 30 in parallel with the steam generation portion 31. The lower portion of detection tank 80 is connected to the lower end portion of steam generation vessel 30 by means of a connection pipe 82 for communication with the steam generation portion 31. The water level detection tank 80 is exposed to the atmosphere as well as the steam generation vessel 30 so that the level of water stored in tank 80 becomes the same as in steam generation vessel 30. A float switch 81 is provided in the detection tank 80 to detect the level of water stored therein. The float switch 81 detects an upper limit L1 of water level at the upper end of the heat generation part 41*a* of heating rods 41 and detects a lower limit L2 of water level at a position lower than the upper limit L1.

The steam generator 20 comprises means 90 for supplying an amount of water into the steam generation vessel 30 through the water level detection tank 80. The water supply means 90 includes a water supply conduit 91 connected at one end with a source of water such as a tap water (not shown) and at the other end with the bottom portion of water level detection tank 80. A water supply valve 92 is disposed in the water supply conduit 91 and mounted to the drain tank 16. When the water supply valve 92 is opened, fresh water from the source of water is supplied into the interior of detection tank 80 through the water supply conduit 91 and supplied into the steam generation vessel 30 through the connection pipe 82.

In operation of the steam generator 20 constructed as described above, the drain valve 34 is closed, and the water supply valve 92 is opened to supply fresh water from the source of water into the water level detection tank 80 through the water supply conduit 91 so that the water is supplied from detection tank 80 into the steam generation vessel 30. When the upper limit L1 of water level in tank 80 is detected by the float switch 81, the water supply valve 92 is closed in response to detection of the float switch to interrupt the supply of water to the steam generation vessel 30. In such an instance, the level of water in steam generation vessel 30 becomes the same as in the detection tank 80 and is maintained at the upper end of heat generation part 41*a* of heater element 40.

When the level of water in vessel 30 becomes the upper limit L1, a processing for supply of steam into the cooking cabinet 12 is executed by control of a controller (not shown) as described below. In this processing, the induction heating coil 50 is supplied with high frequency current to energize the heating element 40 thereby to boil the water in the steam generation portion 31 for generation of steam. The steam generated in vessel 30 spouts upward from the outlet 32*a* of steam passage 32 and is introduced into the interior of cooking cabinet 12 through the discharge duct 70. Since the three perforated intercept plates 61~63 are mounted within the steam passage 32, the generated steam rises through the apertures 61*a*~63*a* of intercept plates 61~63, while boiling water jumping up in the occurrence of steam is received by the intercept plates 61~63 without spouting from the outlet 32*a* of steam passage 32. In such an instance, drops of high temperature hot water contained in the steam are received by and adhered to the ceiling surface of upstanding portion 71 of discharge duct 70. The drops of hot water adhered to the ceiling surface fall into the steam generation portion 31 through the apertures 61*a*~63*a* of intercept plates 61~63, while the steam spouting upward from the outlet 32*a* of steam passage 32 is introduced into the interior of cooking cabinet 12 from the outlet portion 72 of discharge duct 70.

When the amount of water in steam generation vessel 30 decreases due to generation of the steam, the water from detection tank 80 flows into the steam generation vessel through the connection pipe 82. When the level of water in tank 80 becomes lower than the lower limit L2, the float switch 81 operates to open the water supply valve 92 for supply of fresh water from the source of water. This causes a rise of the water level in detection tank 80 under supply of fresh water and a rise of the water level in the steam generation vessel 30 under supply of the fresh water from the detection tank 80. When the water level in detection tank 80 becomes the upper limit L1, the float switch 81 operates to close the water supply valve 92. With such control of supply of the water, the water level in the steam generation vessel 30 is maintained between the upper limit level L1 and lower limit level L2.

After the processing for generation of the steam, a processing for drain of the water is executed as follows. In this processing, the supply of high frequency current to induction heating coil 50 is stopped, and the water supply valve 92 is closed while the drain ball valve 34 is opened. When the drain ball valve 34 is opened, the water in steam generation vessel 30 is discharged into the drain tank 16 through the drain outlet 31*a* and drained to the exterior of the steam convection oven 10. As the drain outlet 31*a* of steam generation vessel 30 is located under the heating rods 40, the water is drained without remaining in vessel 30. This is useful to restrain the occurrence of scale caused by calcium hypochlorite in the steam generation vessel 30.

As in the steam generator, drops of hot water rising by the force of steam generated in the steam generating portion are received by the ceiling surface of the upstanding cylindrical portion 71 of discharge duct 70 and circulated back into the steam generation portion, the steam generator can be provided in a simple construction and in a small size without any separate bypass pipe for circulating the drops of hot water rising together with the steam. In application to a steam convection oven, the steam generator can be assembled in a limited space at one side of a cooking chamber formed in a housing of the steam convention oven. In addition, the drops of hot water circulated into the steam generation portion are useful to enhance the heating efficiency for generating the steam.

As the three perforated intercept plates 61~63 are mounted within the steam passage 32 for receiving drops of hot water jumping from the steam generation portion 31 to spout only the steam upward and for permitting the drops of hot water falling from the ceiling surface of the upstanding cylindrical portion of discharge duct into the steam generation portion 31, drops of high temperature hot water jumping from the steam generation portion can be re-circulated.

As the water level detection tank 80 assembled with the steam generation vessel 31 at one side thereof is provided therein with the float switch 81 for detecting the level of water in the steam generation portion and is communicated with the interior of steam generation vessel 30 at the lower end of induction heating coil 50, the water in detection tank 80 is not heated by high temperature hot water in steam generation vessel 30 to avoid an error in operation of the float.

As the water supplied from the source of water flows into the steam generation portion through the water level detection tank, the water does not remain in the water level detection tank to restrain the occurrence of scale.

The invention claimed is:

1. A steam generator adapted for use in a steam convection oven, said steam generator comprising:

an upright cylindrical steam generation vessel having a vertical steam generation portion formed to store an amount of water for generation of steam;

a water level detection tank disposed vertically at one side of the steam generation vessel and configured to be supplied with water, and a water passage pipe connecting said detection tank with a lower end of the steam generation portion to supply water into the steam generation portion therethrough, said water level detection tank including a water level sensor to detect a water level in the steam generation portion;

a cylindrical holder mounted on an upper end of the steam generation vessel to form a steam passage for spouting steam generated in the steam generation portion;

a heater element disposed within the steam generation portion; and an induction heating coil wound around an outer periphery of the steam generation portion for energizing the heater element;

wherein:

the heater element is energized by activation of the induction heating coil so that steam generated by boiling of water in the steam generation vessel spouts from the steam passage; and a steam discharge duct is mounted on an upper end of the cylindrical holder for discharging steam spouting upward from the steam passage into a cooking chamber of the steam convection oven, the steam discharge duct having a cylindrical portion upstanding from the cylindrical holder and formed with a closed ceiling and an output portion extended from the cylindrical portion in a lateral direction to discharge the steam into the cooking chamber such that drops of hot water adhered to a ceiling surface of the cylindrical portion fall and re-circulate into the steam generation portion, and a plurality of perforated intercept plates are mounted within the cylindrical holder at vertically spaced positions for receiving drops of hot water jumping upward from the steam generation portion to spout only the steam upward and for permitting the drops of hot water falling from the ceiling surface of the cylindrical portion therethrough to be re-circulated into the steam generation portion.

2. The steam generator as claimed in claim 1, wherein said perforated intercept plates are in the form of a middle intercept plate formed at its center with a circular aperture and upper and lower intercept plates each formed with a plurality of circular apertures which are located radially outward from the aperture of the middle intercept plate.

3. The steam generator as claimed in claim 1, wherein:

the steam generation vessel is mounted on a drain tank through a joint tube;

a normally closed valve is disposed within the joint tube to discharge water from the steam generation vessel into the drain tank when it is opened.

4. The steam generator as claimed in claim 1, wherein the heater element is in the form of a plurality of conductive metallic rods circumferentially equally spaced and vertically mounted within the steam generation portion of the vessel.

5. A steam generator adapted for use in a steam convection oven, said steam generator comprising:

an upright cylindrical steam generation vessel having a vertical steam generation portion formed to store an amount of water for generation of steam;

a water level detection tank disposed vertically at one side of the steam generation vessel and configured to be supplied with water, and a water passage pipe connecting said detection tank with a lower end of the steam generation portion to supply water into the steam generating section therethrough, said water level detection tank including a water level sensor to detect a water level in the steam generation portion;

a heater element disposed within the steam generation portion;

an induction heating coil wound around an outer periphery of the steam generation vessel for energizing the heater element; and an upright cylindrical holder mounted on an upper end of the steam generation vessel to form a steam passage for spouting steam generated in the steam generation portion;

wherein:

the heater element is energized by activation of the induction heating coil so that steam generated by boiling of water in the steam generation vessel spouts upward from the steam passage;

a steam discharge duct is mounted on an upper end of the cylindrical holder for receiving the steam spouting upward from the steam passage to discharge the steam in a lateral direction into a cooking chamber of the steam convection oven such that drops of hot water adhered to a ceiling surface of the discharge duct fall and re-circulate back into the steam generation portion; and a plurality of perforated intercept plates are provided within the cylindrical holder at vertically spaced positions for receiving drops of hot water jumping upward from the steam generation portion into the steam discharge duct to spout only the steam upward and for permitting drops of hot water falling from the steam discharge duct therethrough to be re-circulated into the steam generation portion.

* * * * *